United States Patent [19]

Fullalove et al.

[11] 4,068,803

[45] Jan. 17, 1978

[54] ROLLERMILLS

[75] Inventors: Richard Fullalove, Denton; Frederick Spencer, Stockport, England

[73] Assignee: Henry Simon Limited, Stockport, England

[21] Appl. No.: 722,574

[22] Filed: Sept. 13, 1976

[30] Foreign Application Priority Data

Oct. 24, 1975 United Kingdom ..... 43944/75

[51] Int. Cl.[2] ..... B02C 4/32

[52] U.S. Cl. ..... 241/32; 241/232

[58] Field of Search ..... 241/32, 230, 231, 232, 241/233, 234

[56] References Cited

U.S. PATENT DOCUMENTS

| | | | |
|---|---|---|---|
| 2,131,277 | 9/1938 | Frerotte | 241/232 |
| 2,273,772 | 2/1942 | Pollitz | 241/32 |
| 3,845,906 | 11/1974 | Lillig et al. | 241/231 X |

FOREIGN PATENT DOCUMENTS

| | | | |
|---|---|---|---|
| 2,132,149 | 1/1973 | Germany | 241/32 |
| 291,170 | 9/1953 | Switzerland | 241/232 |
| 729,196 | 5/1955 | United Kingdom | 241/230 |

*Primary Examiner*—Roy Lake
*Assistant Examiner*—Howard N. Goldberg
*Attorney, Agent, or Firm*—Norris & Bateman

[57] ABSTRACT

A rollermill having a pair of grinding rolls, one fixed and one movable to enable separation of the grinding surfaces thereof, the movable roll being mounted on a pair of pivoted arms, a spring being provided for urging the movable roll into grinding contact with the fixed roll, there being a pair of rigid members held against relative movement by a shear pin for non-resiliently maintaining said movable roll in grinding contact, the shear pin being adapted to fail when a roll-separating force is established in excess of the sum of the force applied by the spring and the force necessary to cause said shear pin to fail, whereby in the event of failure of said shear pin said grinding surfaces continue to be maintained in grinding relationship resiliently by said spring.

7 Claims, 2 Drawing Figures

ROLLERMILLS

This invention relates to rollermills for use in the flour milling industry.

A rollermill comprises a pair of grinding rolls, one of which is movable to separate the grinding surfaces thereof, for example, when no stock is flowing to the rolls. When the surfaces are together for grinding, the movable roll is resiliently urged into grinding contact by a heavy spring which allows the rolls to separate if any obstruction passes between them but which is sufficiently heavy to prevent the rolls from opening merely in the presence of stock feed. Thus, a grinding load is applied by the spring.

This arrangement is sometimes found to provide an unsteady grinding load, oscillations being set up from time to time during grinding. One known method of overcoming this difficulty has been to replace the spring with a shear pin arrangment designed to fail at a certain roll-separating force thus to avoid any severe damage to the machine parts. However, in the event of pin failure, the rolls separate and the grinding condition is lost resulting in machine downtime and loss of production for a considerable time.

One object of the present invention is to provide a rollermill wherein the aforementioned problems are at least substantially overcome.

According to the present invention there is provided a rollermill comprising a pair of grinding rolls one of which is movable to separate the grinding surfaces thereof, resilient means for urging surfaces together for grinding, and a pair of members held against relative movement by a shear pin for non-resiliently maintaining said surfaces engaged for grinding, the shear pin being adapted to fail when a roll-separating force is established in excess of the sum of the force applied by said resilient means and the force necessary to cause said shear pin to fail, whereby in the event of failure of said shear pin, said grinding surfaces continue to be maintained in grinding relationship resiliently by said resilient means.

An embodiment of the invention will now be described, by way of example only, with reference to the accompanying drawings in which.

Figure 1:
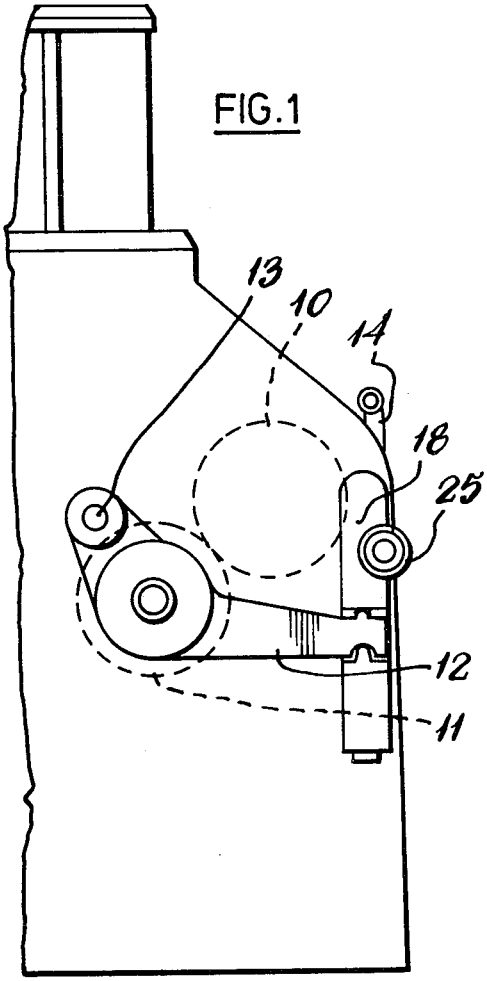
FIG. 1 is a partial end elevation of a rollermill.

The rollermill essentially comprises a pair of parallel grinding rolls 10 and 11 adapted for rotation with their peripheral surfaces in grinding contact when stock to be milled is fed thereto.

The roll 10 is rotatably mounted in the machine frame whilst the roll 11 is mounted on a pair of arms 12, one on each end of the machine, the arms being pivoted at 13 whereby the roll 11 can be moved towards and away from the roll 10.

Although most modern rollermills include means for mechanical and automatic movement of the roll 11, for the purpose of this description a more conventional device such as an eccentrically mounted lever 14 is described and illustrated.

Figure 2:
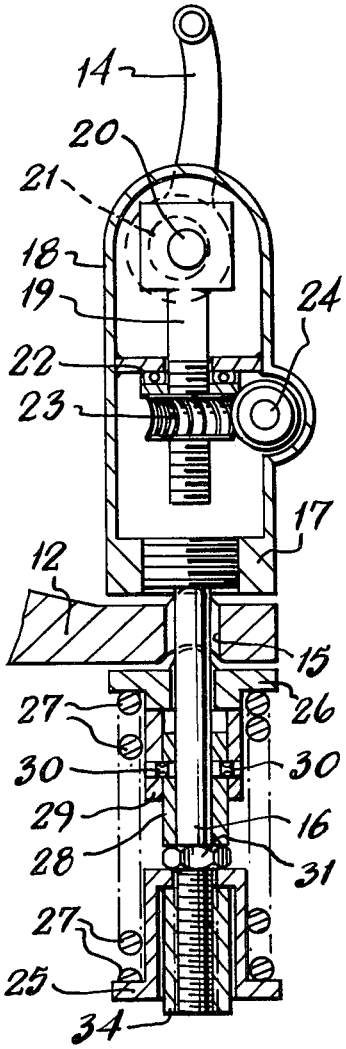
FIG. 2 is an enlarged vertical section of part of the rollermill illustrated in FIG. 1.

Referring now to FIG. 2, which illustrates a mechanism at one end of the rollermill, the associated arm 12 includes a vertical aperture 15 adjacent its free end. A rod 16 passes through the aperture 15 and is secured at its upper end in the base 17 of a casing member 18. Mounted within the casing 18 is a threaded member 19 through which passes a pin 20 for rotation in an aperture in the upper end of the member 19. The pin 20 is fixed eccentrically to a shaft 21 carrying the lever 14. The shaft extends the full length of the rollermill and carries a similar pin 20 at the other end. The casing 18 carrying the rod 16 is itself carried on the threaded member 19 by means of a thrust bearing 22 disposed above a worm wheel 23 which meshes with a worm 24 rotatably mounted in the casing 18. The worm 24 can be used to rotate the worm wheel 23 thus to raise and lower the casing 18 relative to the member 19. Thus, for a given position of the member 19, the casing member 18, the rod 16 and the free end of arm 12 can be adjusted in height. Therefore the grinding position of the roll 11, and the grinding load applied between the rolls, can be adjusted by rotation of the worm 24, and the grinding rolls can be moved completely apart by turning the lever 14 clockwise in FIG. 2, which causes the member 19, casing 18, rod 16, and thus the arm 12 to drop relative to the machine frame.

The lower end of the rod 16 is threaded to receive a nut 34 which retains the lower end of a pair of collars 25 and 26 which support between them a heavy coil spring 27. Thus it will be seen that the spring 27 serves as a resilient means for urging the roll 11 into grinding engagement with the roll 10. Should any obstacle pass between the rolls in operation, then the arm 12 is deflected downwardly against collar 26 and the spring 27, to allow the obstacle to pass.

A pair of annular members 28 and 29 inside of the coil spring 27 surround the rod 26 and are prevented from moving relatively in an axial direction by a shear pin or pins 30. A locknut 31 is mounted on the threaded end of the rod 16 so that during assembly the collar 26, and members 28 and 29 can be fixed in position prior to applying the spring 27, collar 25 and nut 34. In this way the nut 34 tightens the collar 25 against the locknut 31 without further stressing the shear pins 30.

It will be seen therefore, that whilst the initial grinding load is applied by the spring 27 there is a combined loading against downwards movement of the arm 12 which is equivalent to the sum of the pressure or grinding load applied by the spring, and the force required to break the shear pin or pins 30. Should a condition arise when, due to an obstacle passing between the grinding rolls 10 and 11, a roll-separating force is experienced in excess of the cumulative force just mentioned, then the shear pin or pins will fail before failure of any other part of the machinery such as the free end region of the arm 12.

It will be appreciated that failure of the shear pin or pins does not necessarily result in the rollermill being put out of action immediately as there is still the grinding load provided by the spring 27. Thus the machine can continue to operate until it is convenient to replace the shear pin or pins.

It will be appreciated that it is not intended to limit the invention to the above example only, many variations, such as might readily occur to one skilled in the art, being possible without departing from the scope of the invention as defined by the appended claims.

For example, the locknut 31 can be replaced by a plurality of shims about the rod 16 with a collar on the side of the shims remote from the shear pin arrangement, lockable on the rod by means of a grub screw or similar device.

What we claim is:

1. In a rollermill comprising a pair of rotatable grinding rolls, means mounting one of said rolls for displacement relative to the other and comprising a movable actuating member for determining said displacement, resilient means providing a roll separation resisting force acting directly on said member for urging said one roll toward the other roll for normally maintaining the surfaces of said rolls in grinding engagement while permitting separation of said surfaces in the event an obstacle passes between them during grinding, and means including shear pin means effective after a predetermined separation of said surfaces permitted by said resilient means for substantially solidly resisting further movement of said member and thereby resisting further relative separation of said surfaces, said shear pin means being constructed and arranged to fail upon said predetermined separation of said roll surfaces when the roll separation force acting on said member exceeds the combined resisting forces of said resilient means and said shear pin means to permit increased separation of said surfaces to non-grinding position while the full force of the resilient means alone remains acting on said member, whereby in the event of failure of said shear pin means and subsequent passage of the condition causing said increased separation of the roll surfaces said resilient means will continue with full force to urge said surfaces toward normal grinding relation.

2. In the rollermill defined in claim 1, said member comprising an arm pivoted near one end and on which said one roll is supported, said shear pin means being disposed to act on the free end of said arm and comprising a pair of members connected by a shear pin, and said resilient means comprising spring means surrounding said shear pin means and acting on the free end of said arm.

3. A rollermill according to claim 1, wherein said one grinding roll is carried at opposite ends thereof by arms pivoted on a common axis, the free ends of which arms are mounted for movement about said pivot axis along relatively stationary rods, there being a pair of collars mounted on each of said rods, one of said collars on each rod being movable relative to said other collar and to its rod and being in abutment with one of said arms, and the other of said collars being fixed to its rod, and said resilient means being mounted in compression between said collars.

4. A rollermill according to claim 3, wherein the axis of rotation of said other grinding roll is fixed relative to the machine frame and each said rod is adjustable relative thereto, thereby to adjust the position of each said arm and thus the relative positions of the roll surfaces, and the grinding load therebetween.

5. A rollermill according to claim 4, wherein each said rod is further movable to enable the surfaces of said grinding rolls to be moved completely apart in the absence of stock to be milled.

6. A rollermill according to claim 3, wherein said shear pin means comprises a shear pin mounted between two concentric annular members otherwise freely mounted on each said rod, and said resilient means comprises a coil spring mounted concentrically with each said pair of annular members.

7. A rollermill as defined in claim 3, wherein each said other collar is fixed on its associated rod between an adjustable locking nut and a retaining nut, and said shear pin means comprises a pair of annular members on each said rod interconnected by a shear pin and disposed in opposite end abutment with said one collar and said locking nut.

* * * * *